US005924228A

United States Patent [19]

Yang

[11] Patent Number: 5,924,228

[45] Date of Patent: Jul. 20, 1999

[54] SAFETY SIGN

[76] Inventor: Chin-Lai Yang, No. 257, Hsing-Her Road, Dah-Duh Shiang, Taichung Hsien, Taiwan

[21] Appl. No.: 08/971,773

[22] Filed: Nov. 17, 1997

[51] Int. Cl.[6] ..... G09F 15/00

[52] U.S. Cl. ..... 40/610; 40/612; 40/606

[58] Field of Search ..... 40/606, 607, 610, 40/612; 248/284.1

[56] References Cited

U.S. PATENT DOCUMENTS

| | | | |
|---|---|---|---|
| 4,490,934 | 1/1985 | Knapp | 40/612 X |
| 4,952,910 | 8/1990 | Straten et al. | 40/612 X |
| 5,503,356 | 4/1996 | Shelby | 40/610 X |
| 5,540,007 | 7/1996 | Kulp et al. | 40/610 |
| 5,561,931 | 10/1996 | Duenkel | 40/607 X |
| 5,572,188 | 11/1996 | McDowell, II | 40/610 X |

*Primary Examiner*—Brian K. Green
*Attorney, Agent, or Firm*—Charles E. Baxley

[57] ABSTRACT

A safety sign includes a base, and a sign member supported on the base for allowing the sign member to be supported at a suitable height. The base includes a tube secured on a foot support for securing the sign member. A post has a lower portion slidably engaged in the tube for allowing the sign member to be adjusted relative to the base. A coupler is secured on top of the post and a pair of arms are pivotally coupled to the coupler. A pair of springs may bias the arms to the expand or the working position. A pair of beams may be pivotally coupled between the arms and the post for forming a triangular structure. The coupler and the arms and the beams may include a reflective outer surface and may include one or more lights for generating warning signals.

7 Claims, 4 Drawing Sheets

SAFETY SIGN

BACKGROUND OF THE INVENTION

1. Field of the Invention

The present invention relates to a sign, and more particularly to a safety sign.

2. Description of the Prior Art

Typical safety signs for vehicle and for showing a parking vehicle comprise a triangular configuration. The safety sign may be disposed on the ground and disposed in front of the vehicle for warning the coming vehicles that a vehicle is parked on the road side and for preventing the parking vehicle from being hit by the other vehicles. However, the triangular safety sign may not be stably supported in place. In addition, the safety road sign is normally disposed on the ground and may not be clearly seen by the coming vehicles. Furthermore, the coming vehicles may not clearly see the safety sign if the safety sign has not be directed to a suitable angular position.

The present invention has arisen to mitigate and/or obviate the afore-described disadvantages of the conventional safety signs.

SUMMARY OF THE INVENTION

The primary objective of the present invention is to provide a safety sign which may be stably supported in place and which may be supported at a suitable height.

The other objective of the present invention is to provide a safety sign which includes a light device for generating a clear warning sign.

In accordance with one aspect of the invention, there is provided a safety sign comprising a base, and a sign member supported on the base for allowing the sign member to be supported at a suitable height.

The base includes a foot support and a tube secured on the foot support, the sign member is secured on the tube. The sign member includes a post having a lower portion slidably engaged in the tube for allowing the sign member to be adjusted relative to the base. The sign member includes a coupler secured on top of the post, a pair of arms each having an inner end pivotally coupled to the coupler at a pivot axle for allowing the arms to be rotated between a working position and a folded position, and means for biasing the arms to the working position. The coupler includes a reflective outer surface. The arms each includes at least one light for generating a warning signal.

The sign member includes a slide slidably engaged on the post and the tube, and a pair of beams each having a lower end pivotally coupled to the slide and each having an upper end pivotally coupled to the arms. The sign member includes a pair of links pivotally coupling the upper ends of the beams to the arms. The sign member includes a retainer secured on the post for engaging with the arms and for retaining the arms at the folded position. The retainer includes a middle sleeve for engaging with the post and includes two side sleeves for engaging with the arms and for retaining the arms in place. The beams each includes at least one light for generating a warning signal.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
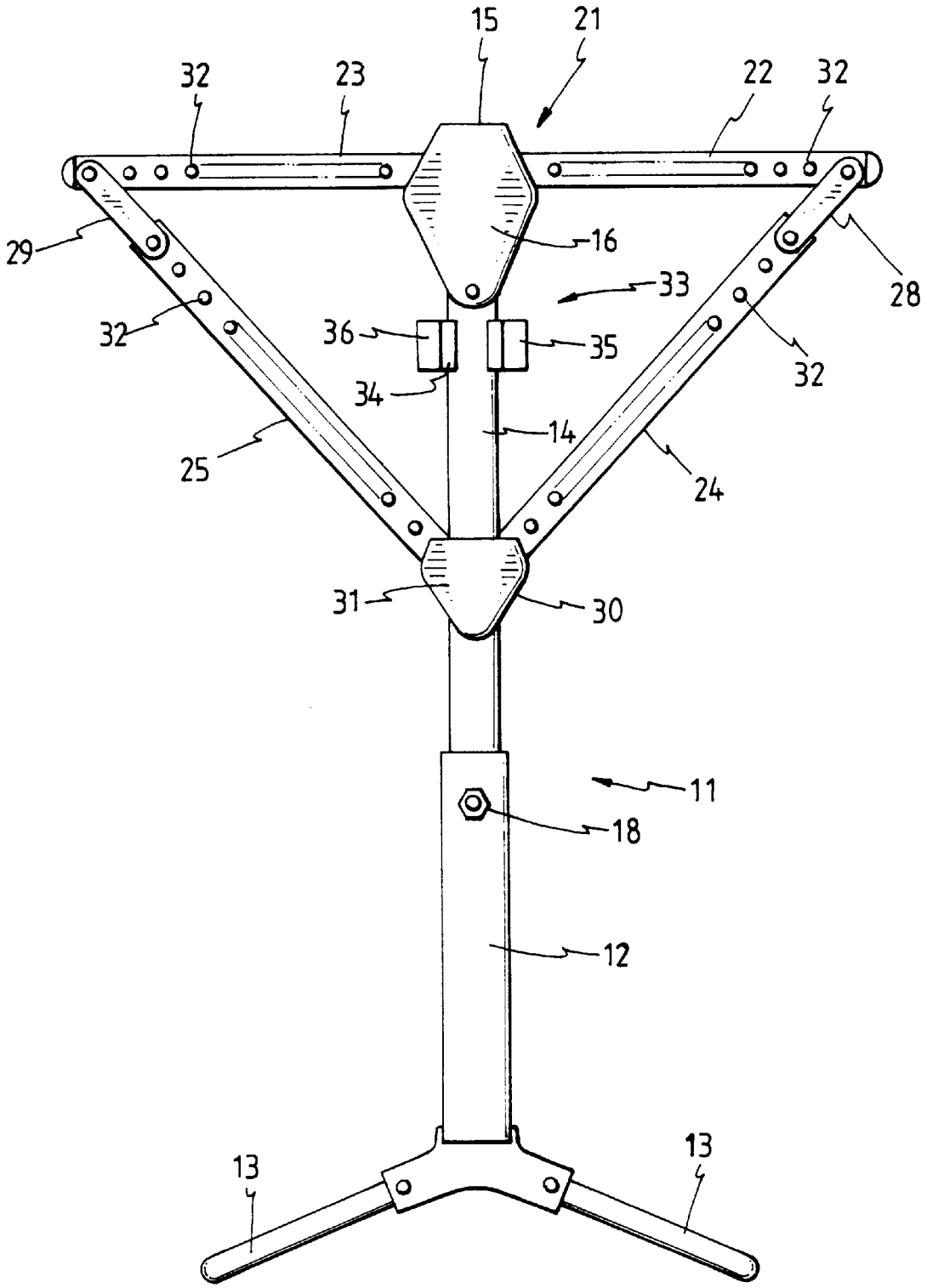
FIG. 1 is a front view of a safety sign in accordance with the present invention.
Figure 2:
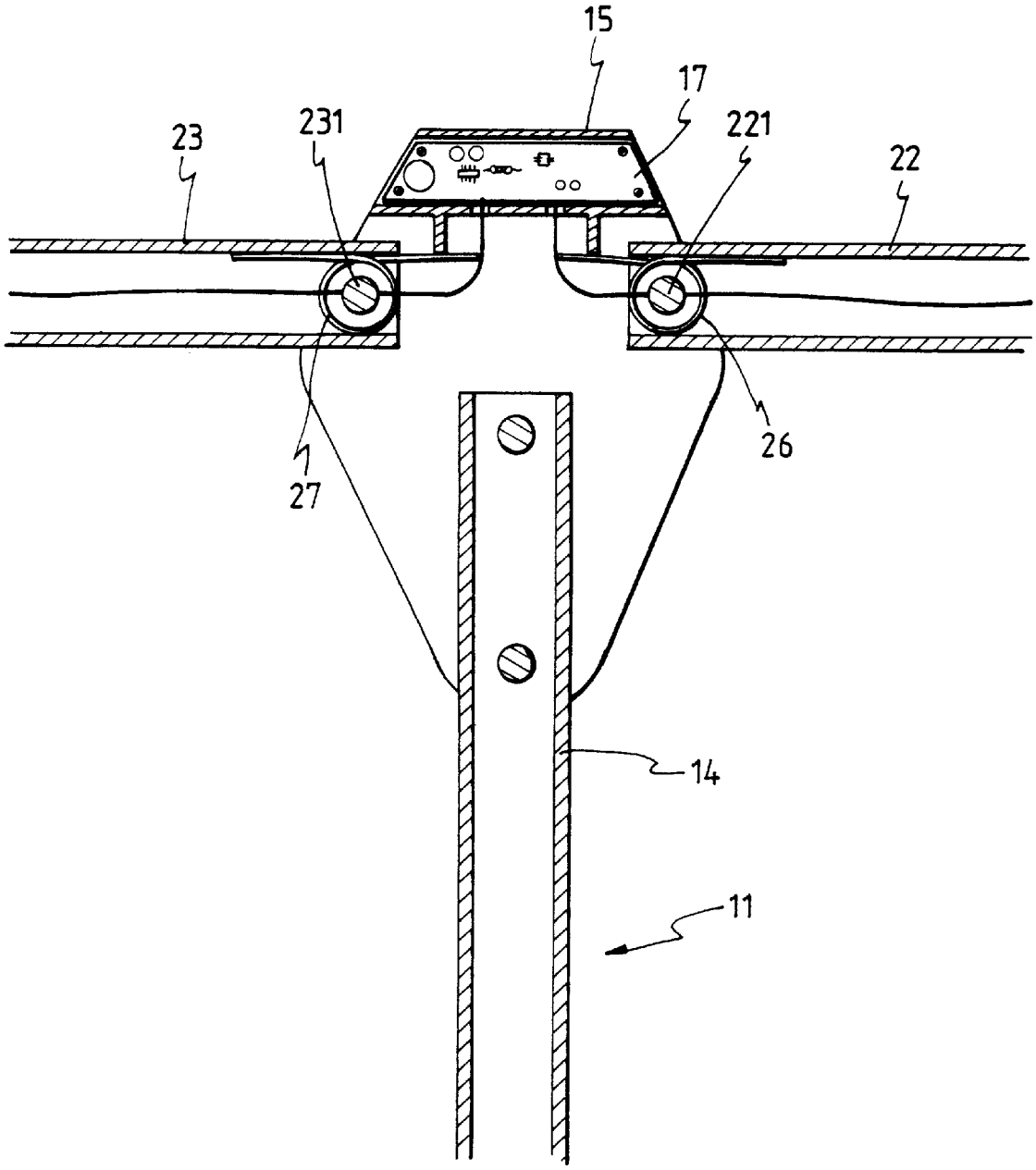
FIG. 2 is a partial cross sectional view of the safety sign.

Referring to the drawings, and initially to FIGS. 1 and 2, a safety sign in accordance with the present invention comprises a base 11 and a sign member 21 disposed on top of the base 11 for allowing the sign member 21 to be supported at a suitable height. The base 11 includes a foot support 13 and a tube 12 secured on the foot support 13 and arranged at an upright position. A post 14 includes a lower portion slidably engaged in the tube 12 and secured in place by a fastener 18, for allowing the post 14 to be adjusted upward and downward relative to the base 11. A coupler 15 is secured on top of the post 14. An electric board 17 is secured in the coupler 15. One or more batteries may be engaged in the coupler 15 for energizing the electric elements secured to the electric board 17.

The sign member 21 includes a pair of arms 22, 23 each having an inner end pivotally secured to the coupler 15 at a pivot axle 221, 231 and each having an outer end. A slide 30 is slidably engaged on the post 14 and the tube 12. A pair of beams 24, 25 each includes a lower end pivotally coupled to the slide 30 and each includes an upper end pivotally coupled to the outer ends of the arms 22, 23 by a pair of links 28, 29. The upper ends of the beams 24, 25 may also be pivotally coupled to the outer ends of the arms 22, 23 directly without the links 28, 29. A pair of springs 26, 27 are engaged on the pivot axles 221, 231 and engaged with the arms 22, 23 for biasing the arms 22, 23 to a horizontal or working position (FIG. 2). The arms 22, 23 and the beams 24, 25 may form a triangular configuration when the arms 22, 23 are biased to the working position.

Figure 3:
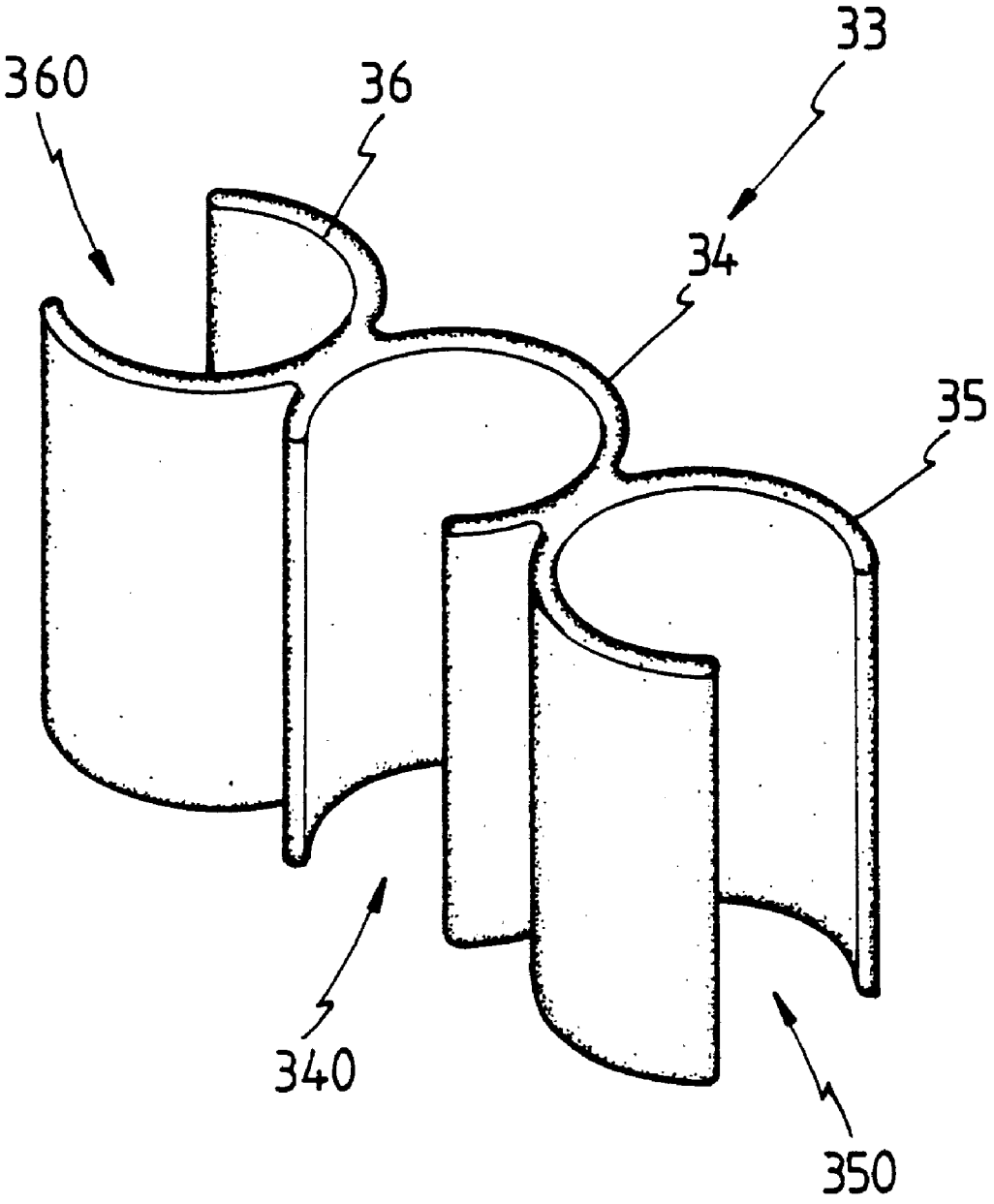
FIG. 3 is a perspective view of a retainer.
Figure 4:
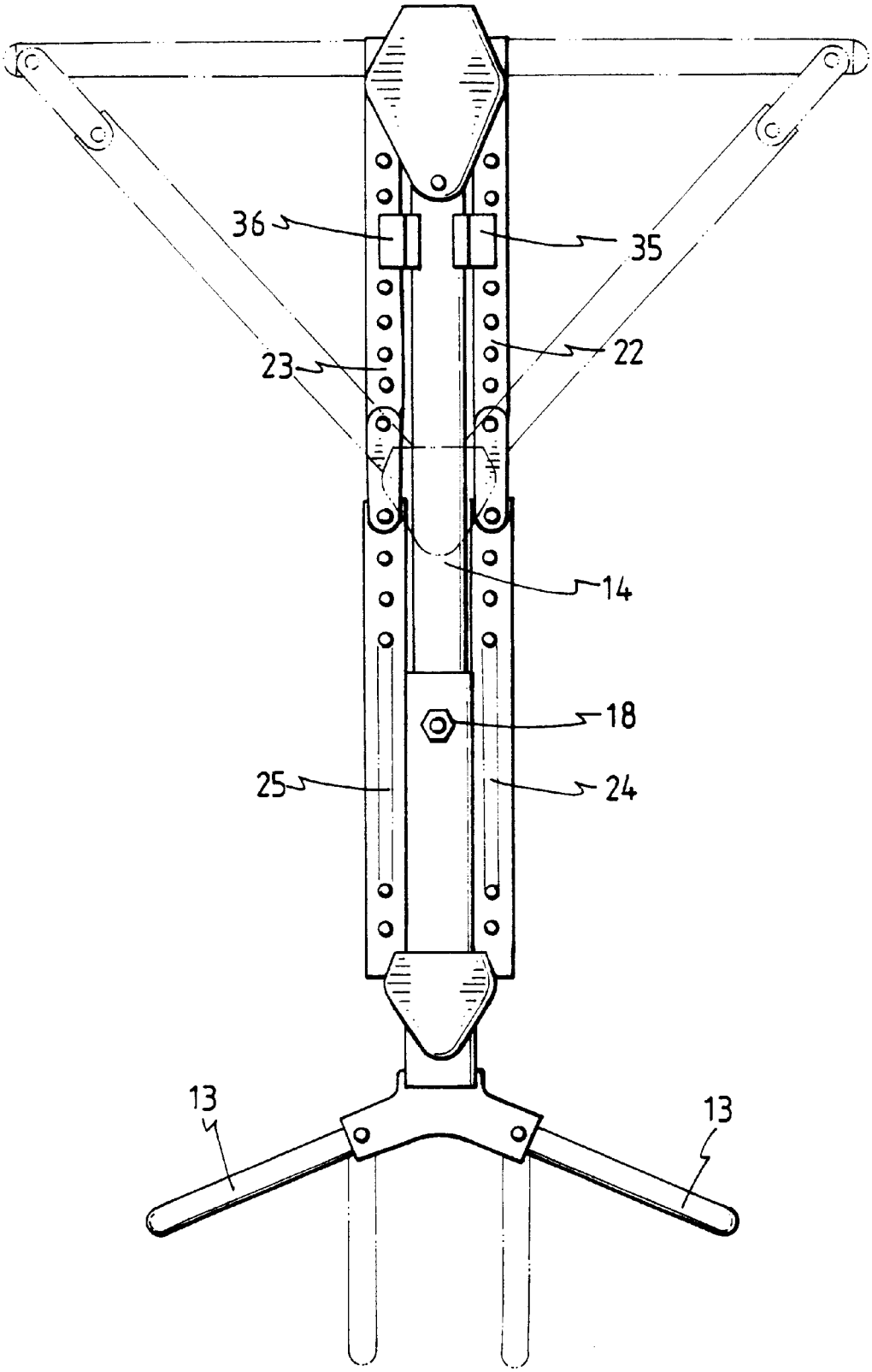
FIG. 4 is a front view illustrating the operation of the safety sign.

As shown in FIGS. 1, 3 and 4, a retainer 33 includes a middle sleeve 34 having an opening 340 for allowing the retainer 33 to be engaged onto the post 14. The retainer 33 also includes two side sleeves 35, 36 each having an opening 350, 360 for engaging with the arms 22, 23 or for engaging with the beams 24, 25 and for retaining the sign member 21 at a folded position (FIG. 4).

The outer surfaces of the coupler 15 and the slide 30 and/or the arms 22, 23 and the beams 24, 25 preferably include a reflective outer sheet 16, 31 for reflecting light and for forming a safety sign. The arms 22, 23 and the beams 24, 25 each preferably includes one or more lights 32, such as light emitting diode (LED) or other lighting devices, for generating warning signals. The lights 32 are electrically coupled to the circuit board 17 so as to be controlled by the circuit board 17.

Accordingly, the safety sign in accordance with the present invention includes a sign member that may be stably supported in place and that may be supported at a suitable height. The safety sign further includes a light device for generating a clear warning sign.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A safety sign comprising:

a base including a foot support and a tube secured on said foot support, a sign member secured on said tube of said base for allowing said sign member to be supported at a suitable height, said sign member including a post having a lower portion slidably engaged in said tube for allowing said sign member to be adjusted relative to said base, said sign member including a coupler secured on top of said post and including a pair of arms each having an inner end pivotally coupled to said coupler at a pivot axle for allowing said arms to be rotated between a working position and a folded position, and said sign member including means for biasing said arms to the working position, said sign member including a slide slidably engaged on said post, and a pair of beams each having a lower end pivotally coupled to said slide and each having an upper end pivotally coupled to said arms.

2. The safety sign according to claim 1, wherein said coupler includes a reflective outer surface.

3. The safety sign according to claim 1, wherein said arms each includes at least one light for generating a warning signal.

4. The safety sign according to claim 1, wherein said sign member includes a pair of links pivotally coupling said upper ends of said beams to said arms.

5. The safety sign according to claim 1, wherein said sign member includes a retainer secured on said post for engaging with said arms and for retaining said arms at the folded position.

6. The safety sign according to claim 5, wherein said retainer includes a middle sleeve for engaging with said post and includes two side sleeves for engaging with said arms and for retaining said arms in place.

7. The safety sign according to claim 1, wherein said beams each includes at least one light for generating a warning signal.

* * * * *